US006395041B1

(12) United States Patent
Voswinckel

(10) Patent No.: US 6,395,041 B1
(45) Date of Patent: May 28, 2002

(54) METHOD AND APPARATUS FOR SIZING A YARN SHEET

(75) Inventor: Gerhard Voswinckel, Aachen (DE)

(73) Assignee: Sucker-Müller-Hacoba GmbH & Co., Mönchengladbach (DE)

( * ) Notice: Subject to any disclaimer, the term of this patent is extended or adjusted under 35 U.S.C. 154(b) by 0 days.

(21) Appl. No.: 09/538,538

(22) Filed: Mar. 30, 2000

(30) Foreign Application Priority Data

Mar. 30, 1999 (DE) ..... 199 14 285

(51) Int. Cl.[7] ..... D06M 11/00

(52) U.S. Cl. ..... 8/115.6; 8/147; 8/151.2; 28/179; 28/183; 427/389.9; 427/392

(58) Field of Search ..... 8/115.6, 147, 151.2; 28/179, 183; 427/389.9, 392

(56) References Cited

U.S. PATENT DOCUMENTS 4,118,183 A * 10/1978 Godau et al. ..... 8/18 R
5,397,633 A * 3/1995 McAbee et al. ..... 428/290
5,626,952 A * 5/1997 McAbee et al. ..... 442/154

FOREIGN PATENT DOCUMENTS

DE 42 34 279 C2 4/1994
DE 42 37 962 C2 5/1994

* cited by examiner

*Primary Examiner*—Gregory Delcotto
*Assistant Examiner*—Derrick G. Hamlin
(74) *Attorney, Agent, or Firm*—Kennedy Covington Lobdell & Hickman, LLP

(57) ABSTRACT

In a method and apparatus for sizing a yarn sheet, the yarn sheet is passed over rollers through a wetting unit and a following roller nip that reduces the moisture content to a selected level. The wetted yarn sheet then passes through a sizing unit and over rollers forming a nip to reduce the sizing content to a desired level. The rollers of the wetting unit and the rollers of the sizing unit are in close proximity to minimize the reach of the yarn sheet there between and thereby minimize the heat loss in the yarn sheet. The reach is covered by a cover having a heater that extends over the yarn sheet reach to maintain the yarn sheet at a desired temperature as it enters the sizing unit. The temperature of the wetting agent bath in the wetting unit is 65°–95° C., with the temperature of the wetting agent being approximately 5°–10° C. higher than the temperature of the sizing agent bath. The temperature of the yarn sheet entering the sizing unit is maintained at a temperature no less than 10° C. of the sizing agent temperature. The nip of the wetting agent rollers reduces the moisture in the wetted yarn sheet to 25% to 50%.

4 Claims, 3 Drawing Sheets

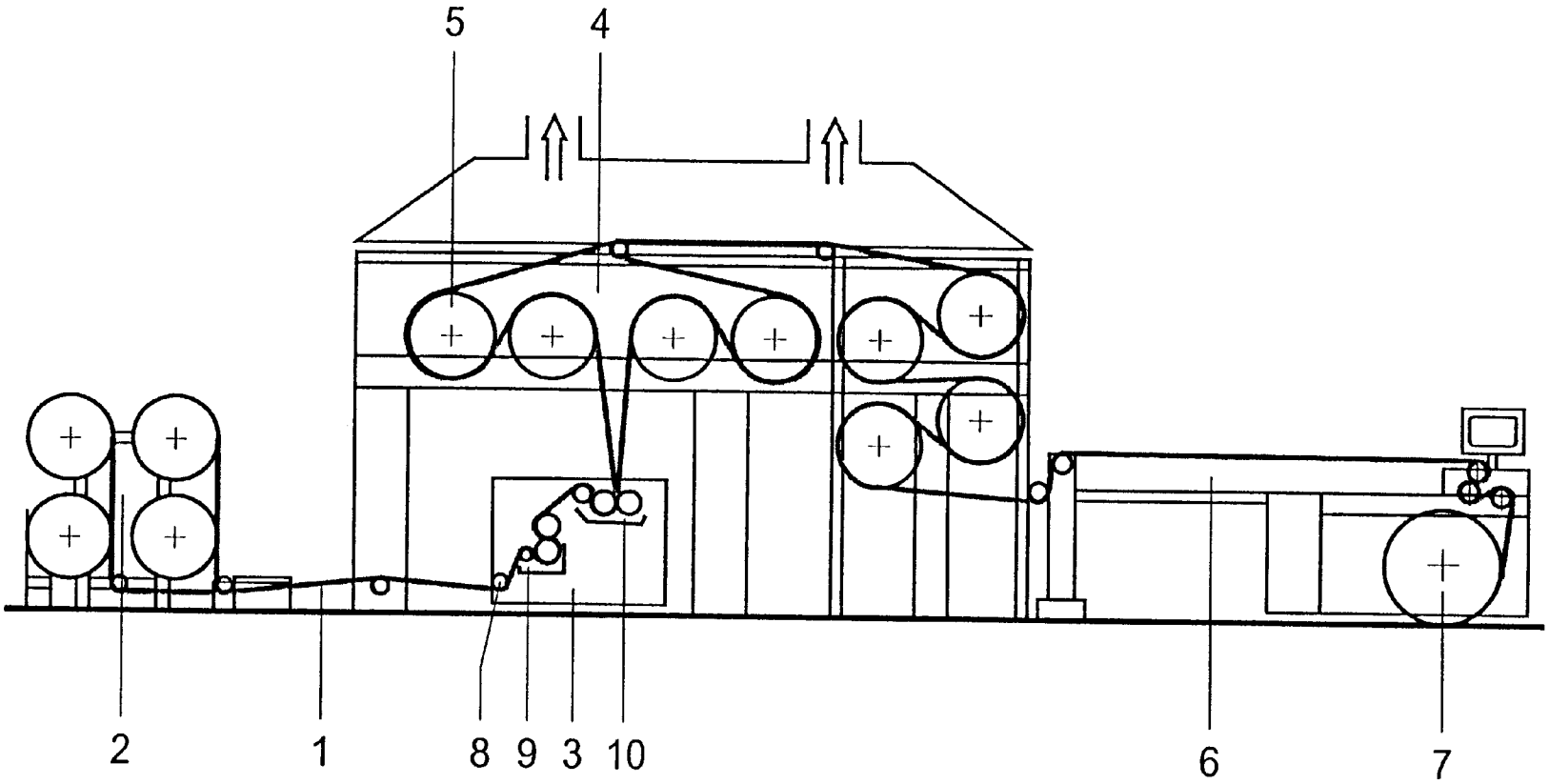
Figur 1

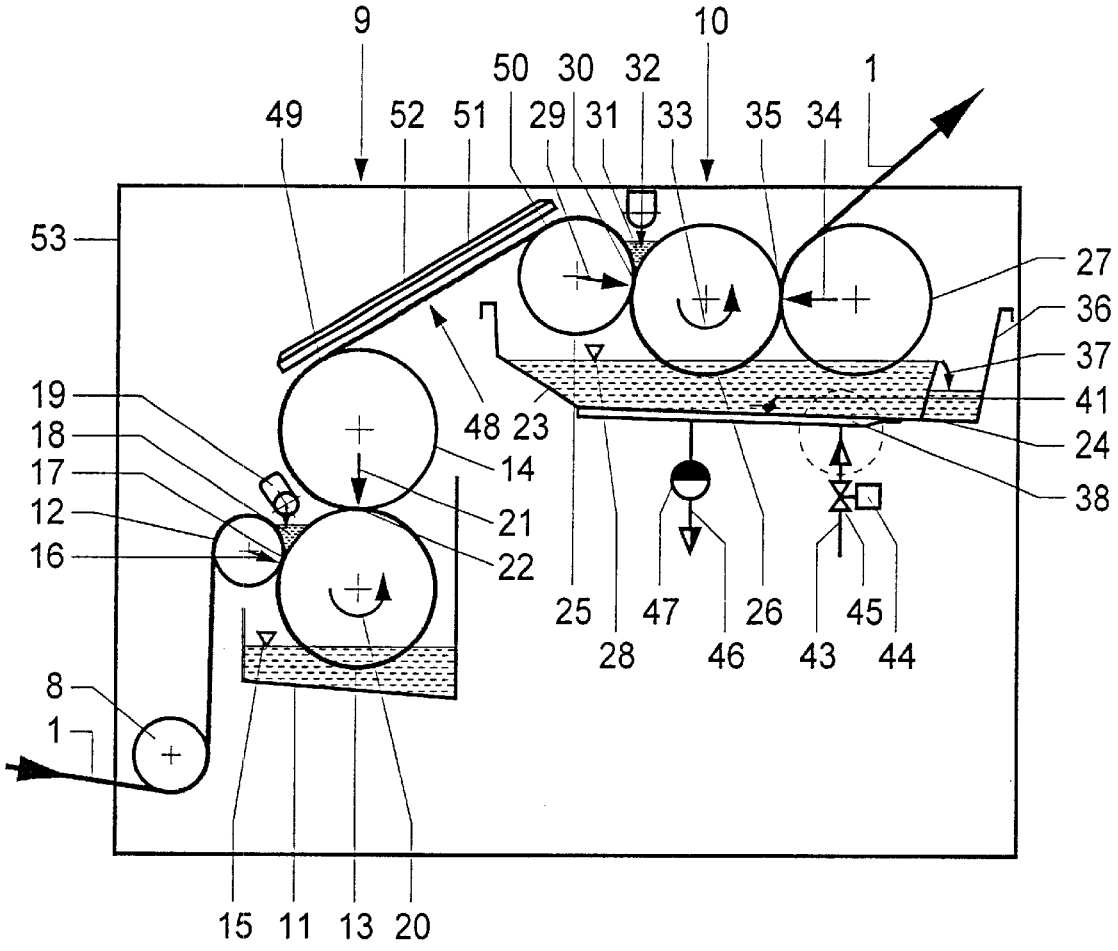
Figur 2

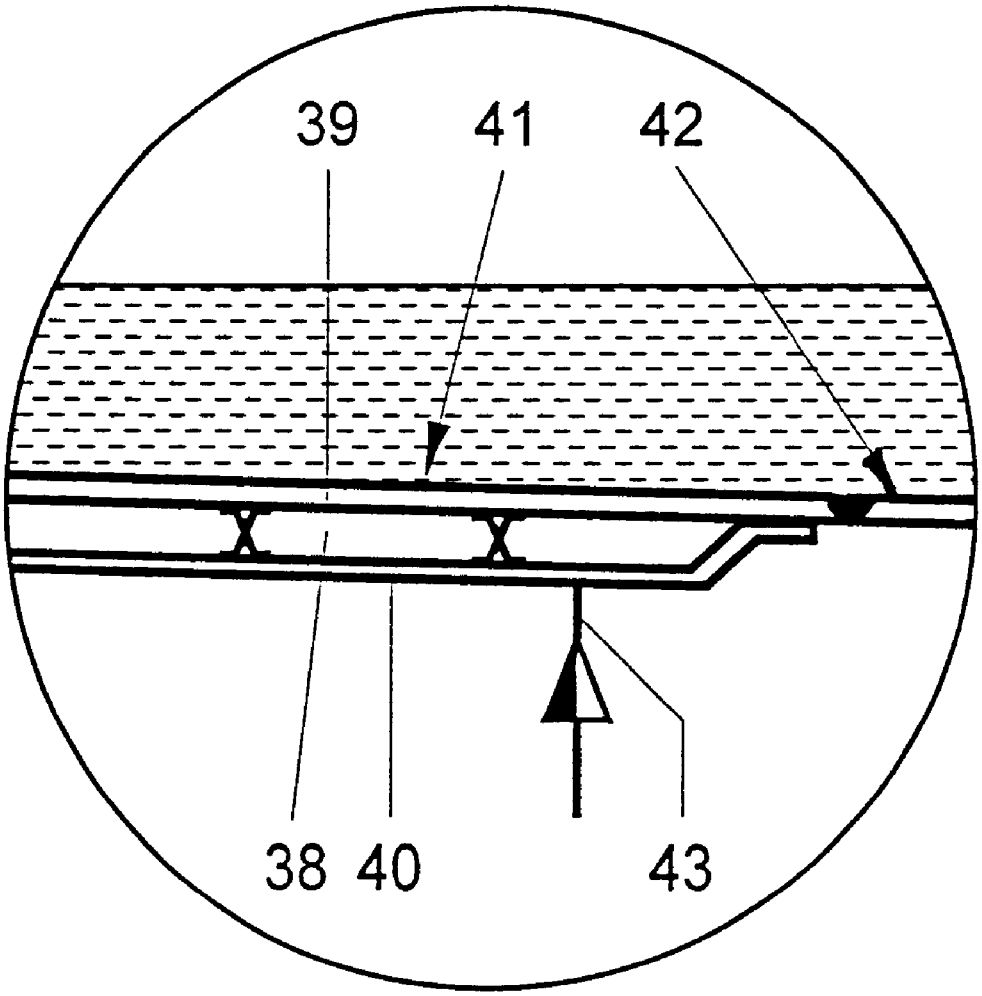
Figur 3

METHOD AND APPARATUS FOR SIZING A YARN SHEET

CROSS-REFERENCES TO RELATED APPLICATIONS

This application claims the benefit of German patent application DE 199 14 285.8, filed Mar. 30, 1999, herein incorporated by reference

FIELD OF THE INVENTION

The invention relates to a method and apparatus for sizing a yarn sheet, wherein in a first step wetting agent, which is at a temperature of 65 to 95° C., is applied to the yarn sheet, which is then squeezed until it contains a selected residual moisture, and in a second step a sizing agent, which is at a temperature of 65 to 95° C., is applied to the yarn sheet, which is then squeezed until it contains a selected residual moisture.

BACKGROUND OF THE INVENTION

In preparation for weaving, a sizing is applied to warp yarn in the form of a yarn sheet. In the process, the yarn sheet is passed through a sizing bath, is squeezed thereafter and finally dried.

It is known from DE 42 37 962 to pass a warp yarn sheet through a water bath prior to the sizing bath, and to subsequently squeeze the yarn sheet following the water bath. The water bath is heated above room temperature and contains chemical additives. This pre-treatment results in the finishing being pre-loosened and partially washed out. It also improves the absorption capability of the warp yarns.

It is also known from DE 42 34 279 to apply sizing to a sheet of fine-capillary yarn of the micro-filament type, wherein the yarn is pre-wetted in a first step with a liquor which is diluted in comparison to the final concentration of the sizing liquor and is squeezed in a second step until it contains a first residual moisture, and immediately following the squeezing is treated with a sizing liquor at an end concentration, and subsequently is squeezed until it contains a second residual moisture.

The wetting agent is essentially water, containing little or no sizing. The wetting agent is heated to a temperature of close to approximately 90° C. A yarn of the micro- filament type can be produced by this method, which has a core relatively low in sizing or containing no sizing, as well as a sheath sufficiently stable for weaving and containing a relatively large amount of sizing agent.

For successful sizing it is necessary to maintain a defined sizing concentration and a defined sizing temperature in the sizing bath. With too high a sizing concentration, too much sizing is used up, which is undesirably expensive. On the other hand, too low a sizing concentration can lead to problems during subsequent weaving. A defined sizing temperature of, for example, 85° C., is required for setting a viscosity of the sizing bath which assures an even sizing application.

In connection with single-stage sizing without pre-wetting, Applicant knows to set the sizing concentration and the sizing temperature by supplying steam under ambient pressure and adding sizing liquor, hereinafter called sizing agent, to the sizing bath. This setting is performed in such a way that the sizing liquor removed with the yarn sheet and the water, which evaporates because of the high sizing temperature, are continuously replaced.

Applicant furthermore knows to provide the sizing unit with a double sheath heated by steam under ambient pressure. Because of this the amount of steam introduced directly into the sizing bath for heating can be reduced.

If the yarn sheet is pre-wetted in a first step, and sized in a second step, the yarn sheet is already provided with the wetting agent and slightly cooled when it reaches the sizing bath. The pre-wetted yarn sheet absorbs less sizing agent than a dry yarn sheet. When sizing after pre-wetting, more energy is needed for heating the yarn sheet provided with the wetting agent on the one hand, but on the other hand less sizing agent is needed. In the course of heating the sizing bath by supplying steam, a considerable dilution of the sizing concentration can occur at start-up, if no compensating steps are taken. If the sizing concentration is set in such a way that it attains its desired value after start-up, the yarn sheet is charged with too great an amount of sizing at start-up. In this case the initial amount lies above the desired amount of sizing by 15 to 20%, and the desired amount of sizing is only reached after the first 2000 to 3000 m of yarn sheet.

SUMMARY OF THE INVENTION

It is the object of the invention to further develop a method and apparatus for sizing a yarn sheet in such a way that the normal significant dilution of sizing concentration during start-up is minimized.

This object is attained by indirectly heating the sizing agent, preferably by a contact surface at a temperature of 100 to 160°.

It is important that energy is supplied indirectly for heating the sizing agent instead of steam which condenses to water in the sizing bath, thereby diluting the size concentration. Several possibilities of indirect heating of the sizing agent in the size box can be employed, such as one or several heating panels or heating coils arranged in the size box, which are heated by a heating medium, such as steam under pressure, or hot oil, or electricity. It is also important that a temperature of at least 100° C. be maintained at the contact surface by the heating medium, which is at a temperature of greater than 100° C. Temperatures between 120 and 140° C. are particularly advantageous.

Indirect heating of the sizing agent allows the setting of the sizing temperature without the supply of water. Only a defined amount of wetting agent, mainly water, is introduced into the sizing bath by the replacement of wetting agent with sizing agent in the yarn sheet. A defined amount of water evaporates from the sizing bath because of the high sizing temperature. In comparison with the amount of the evaporated water, only a small excess of the amount of water introduced by means of the yarn sheet leads to the dilution of the sizing bath during start-up. The lowering of the sizing concentration during start-up is less than 10%, for example, wherein the equilibrium of the sizing concentration will already be reached after a few hundred meters of the yarn sheet. It is possible to accept such slightly increased initial amounts of sizing agent, namely less than 10%, so that the sizing concentration can be set by adding sizing agent alone. Additional steps, such as the measurement of the sizing concentration and regulation of the sizing application on the basis of weight measurements described, for example, in DE 42 34 279, or by matching the sizing concentration by means of a concentration mixer, are no longer required.

A temperature of the wetting agent in the first step, for example 5 to 10° C. higher than the temperature of the sizing agent in the second step, i.e. the sizing temperature, reduces the temperature difference between the yarn sheet already provided with wetting agent and slightly cooled, and the sizing temperature. The yarn sheet provided with the wetting agent can be heated more rapidly, resulting in less energy being required for heating.

Preferably, cooling of the yarn sheet wetted in the first step until it is acted upon by the sizing agent in the second step is maximally limited to 10° C. Limiting the cooling can take place by the second step immediately following the first step. This can be made possible by a compact construction of the sizing device. The limitation of cooling can also be provided by insulating the yarn sheet by means of a cover and/or the supply of heat to the yarn sheet on the way from the wetting agent bath to the sizing bath. The limitation of cooling assures the low energy consumption in the second step.

In the preferred embodiment, in the first step after pre-wetting the yarn sheet, it is squeezed so it contains a residual moisture between 25 and 60%. The residual moisture corresponds to the weight of the water as a function of the weight of the yarn sheet. The residual moisture of the yarn sheet following sizing and squeezing in the second step is set, as described in DE C 42 34 279, to be the same, but in most cases higher. A comparatively low residual moisture of the yarn sheet after the first step prevents a strong dilution of the sizing bath, adds to a stable sizing concentration and has an advantageous effect on the energy consumption because of the small amount of wetting agent which needs to be heated.

In the apparatus of the present invention, which is suitable for carrying out the method of the present invention, the sizing unit has an indirect heater with a flat contact surface.

Depending on the amount of heat output required, the contact surface constitutes a portion of or the entire bottom of the sizing box, wherein the contact surface of the indirect heater is integrated into the bottom of the size box. This integration and the flatness of the contact surface assure the even heating of the sizing agent in the size box without the danger of sizing agent baking onto a transition edge or onto irregularities. A simple and compact structure of the size box, and therefore of the entire sizing device, is made possible by the integration of the contact surface into the bottom.

Preferably, the indirect heater has a heating plate designed as a steam pressure panel consisting, for example, of two plates which are connected with each other in places and, has a low structural height. Its surface can moreover easily be matched to the required heat output.

It is possible to obtain a compact structure of the sizing apparatus by use of a common housing for the wetting unit and the sizing unit, which is divided into a wetting agent box and a size box by a separating wall.

A compact structure is also obtained by the size box being arranged directly downstream of the wetting agent box and with its bottom at the approximate height of the last roller of the wetting unit. In this case the first roller of the sizing unit is located closely downstream of and slightly above the last roller of the wetting unit. The length of the reach of the yarn sheet between the wetting unit and the sizing unit is reduced by this compact construction. The minimal length of the reach prevents excessive cooling of the yarn sheet. Therefore, only a comparatively small supply of energy from the indirect heater is required for heating the sizing agent. This permits a comparatively small heating panel, for example, which can be advantageously accommodated in the sizing agent bath.

A cover over the yarn sheet reach and preferably a heater in the cover, are further features which present excessive cooling of the yarn sheet on its way from the wetting unit to the sizing unit.

The preferred embodiment of the invention is illustrated in the accompanying drawings and diversified in detail thereafter.

BRIEF DESCRIPTION OF THE DRAWINGS

FIG. 1 is a diagrammatic view of a yarn sizing range incorporating the apparatus for sizing a yarn sheet according to the preferred embodiment of the present innovation;

FIG. 2 is an enlarged diagrammatic view of the yarn sizing apparatus included in FIG. 1; and FIG. 3 is an enlargement of a portion of the bottom of the size box of FIG. 2.

DETAILED DESCRIPTION OF THE PREFERRED EMBODIMENT

A range for sizing a yarn sheet 1 represented in FIG. 1 has a feeding section 2, a sizing apparatus 3, a dryer 4 with drying cylinders 5 and a take-up apparatus 6 with a take-up beam 7. The feeding section 2, the dryer 4, in whose housing the sizing device 3 is located, and the take-up device 6 are arranged one behind the other in the conveying direction of the yarn sheet 1. The sizing device 3 has a reversing roller 8, a wetting unit 9 and a sizing unit 10. It is shown in greater detail in FIG. 2. The reversing roller 8, embodied as a measuring and draw-off roller for the feeding section 2, for example, is located in the lower area, or underneath in front of a wetting agent box 11.

Besides the wetting agent box 11, the wetting unit 9 has three rollers 12, 13 and 14 mounted above the wetting agent box 11. The wetting agent box 11 extends transversely in respect to the conveying direction of the yarn sheet 1 over the entire width of the rollers 12, 13 and 14, which are of the same width. The diameters of the second roller 13 and the third roller 14 are of the same size, the diameter of the first roller 12 is about half of these diameters. The second roller 13 and the third roller 14 are arranged one above the other, and the first roller 12 is arranged in the upper area in front of the second roller 13. In this case the second roller 13 projects into the wetting agent bath in the box 11 as far as below a minimum marker of a level indicator 15. As indicated by an arrow 16, the first roller 12 is provided with pressure means, for example a compressed air cylinder, by means of which it can be pressed against the second roller 13. In this way a first squeeze nip 17 is formed between the first roller 12 and the second roller 13, and a trough 18 is formed above the squeeze nip 17. A wetting agent feed device 19 terminates in this trough 18 to provide wetting agent therein. The second roller 13 is connected with a driving mechanism, as indicated by an arrow 20. As indicated by an arrow 21, the third roller 14 is provided with pressure means, which are threaded rods, by means of which it can be moved toward the second roller and pressed against it. Thus, a second squeeze nip 22 is formed between the second roller 13 and the third roller 14. In this way the rollers 12, 13, 14 form a draw-in unit for the sizing unit 10.

A size box 23 of the sizing unit 10 is arranged closely downstream of the wetting agent box 11 above the level of the wetting agent box 11, and its bottom 24 lies at the height of the aforementioned third roller 14.

Besides the size box 23, the sizing unit 10 has three rollers 25, 26 and 27, arranged in the area of the size box 23. In the same way as the wetting agent box 11, the size box 23 extends transversely in respect to the conveying direction of the yarn sheet 1 over the entire width of the rollers 25, 26 and 27, which are of the same width.

The diameters of the second sizing unit roller 26 and the third sizing unit roller 27 are equal, the diameter of the first sizing unit roller 25 is approximately two-thirds of those diameters. The three rollers 25, 26, 27 are arranged one behind the other, wherein the second and the third rollers 26, 27 are at the same height and extend into the sizing agent bath in the size box 23 as far as below a minimum marker of a level indicator 28. The first roller 25 is arranged in the upper area of the second roller 26. In this case it can extend slightly above the second roller 26. As indicated by an arrow 29, the first roller 25 is provided with pressure means, for example a compressed air cylinder, by means of which it can be pressed against the second roller 26. Because of this, a first squeeze nip 30 is formed between the first roller 25 and the second roller 26, and a trough 31 above it. A sizing agent feed device 32 terminates in this trough 31 to provide sizing therein. The second roller 26 is connected with a driving mechanism, as indicated by an arrow 33. As indicated by an arrow 34, the third roller 27 is provided with pressure means, by means of which it can be moved toward the second roller 26 and pressed against it. Thus, a second squeeze nip 35 is formed between the second roller 26 and the third roller 27.

The size box 23 has an overflow wall 37, which extends parallel in front of a rear wall 36 and is of a height corresponding to the maximum filling level of the bath.

The size box 23 has an indirect heater with a heating panel 38, namely a steam pressure panel, which has been inserted into the bottom 24 of the size box 23. The heating panel 38 has an upper plate 39 and a lower plate 40, which are connected with each other at defined places. Channels, for example in a serpentine pattern, for the heating medium are formed by these connections between the plates 39 and 40. Further spot-shaped connections for stabilizing the heating panel 38 can be provided.

It is important that a contact surface 41 of the upper panel 39 of the heating panel 38, which is oriented toward the interior of the sizing agent bath 23, is level and closes off the bottom 24 by means of an inner surface 42 (see FIG. 3). A steam feed line 43, with a valve 45 which is provided with a control 44, leads to the heating panel 38 embodied as a steam pressure panel. A discharge line with a condenser 47 for discharging the heating medium, namely the steam, is connected to the heating panel 38.

Instead of being designed as a steam pressure panel, the heating panel 38 can be designed as a hot oil panel or as an electrically heatable panel. In place of two plates 39, 40, which constitute conduits for the heating medium, it is for example possible to provide heating coils or heating tubes, which are connected with each other, for the heating medium underneath the bottom 24 or in another panel. It is important that the indirect heater has a flat contact surface 41. As in this example, the contact surface 41 can constitute a portion of the bottom 24 and ends flush with the inner surface 42 of the bottom 24. But it can also extend over the entire bottom 24 of the size box 23.

The sizing apparatus 3 has a compact structure provided by the arrangement of the wetting agent box 11 and of the rollers 12, 13, 14 of the wetting unit upstream of the size box 23, wherein the rollers 13, 14 of the wetting unit 9 are arranged one above the other, and the size box 23 above the wetting agent box 11. Because of this arrangement the length of the reach 48, over which the yarn sheet 1 is conducted from the last roller 14 of the wetting agent box 11 to the first roller 25 of the size box, is reduced. The reach 48 extends between a departure point 49 of the yarn sheet 1 at the surface of the last roller 14 of the wetting unit 9 and an arrival point 50 of the yarn sheet at the surface of the first roller 25 of the sizing unit 10, i.e. between the contact points 49 and 50 of a tangent line drawn on the surface of the rollers 14 and 25. The size of the reach is in the order of 1 m, preferably 250 to 750 mm.

A cover 51 with a heater 52 can be provided above the reach 48. The wetting unit 9 and the sizing unit 10 can have a common housing 53.

In the course of operation, the yarn sheet 1 is pulled off the feeding section 2, is conducted through the sizing apparatus 3 and over the drying cylinder 5 of the dryer 4 to the take-up apparatus 6. It is wound onto a take-up beam 7 in the take-up apparatus 6.

In a first step, the yarn sheet in the sizing device 3 is acted upon by the wetting agent bath in the wetting unit 9, preferably water at a temperature between 65 and 95° C., and is squeezed to contain a residual moisture of 25 to 60%. The temperature of the wetting agent is set to be approximately 5° C. higher, for example, than that of the sizing agent. The residual moisture of the yarn sheet 1 when it leaves the wetting unit 9 is determined as a function of the wetting capability of the yarn sheet 1 and the wetting agent temperature.

In the sizing unit 10 the yarn sheet 1 is acted upon by the sizing agent bath in the size box 23 at a temperature between 65 and 95° C. in a second step, and is squeezed to contain a residual moisture of 80 to 160%.

The yarn sheet 1 is twice charged with wetting agent and subsequently twice squeezed. To this end, the yarn sheet 1 is guided from below over the reversing roller 8 around the top of the first roller 12 of the wetting unit 9 into the trough 18, which is filled with wetting agent and is acted upon by the wetting agent. The yarn sheet 1 is squeezed for the first time in the first squeeze nip 17 underneath the wedge 18. Thereafter the yarn sheet 1 is conducted around the bottom of the second roller 13, and therefore through the wetting agent bath in the wetting agent box 11 and the wetting agent again acts on it. Then the yarn sheet 1 is further conducted around the top of the second roller 13 through the second squeeze nip 22, where it is squeezed to contain the predetermined residual moisture. The squeezing force in the second squeeze nip 22 is customarily greater, for example ten times greater, than in the first squeeze nip 17.

The yarn sheet 1, which had been twice wetted and squeezed, i.e. is provided with wetting agent and heated to the wetting agent temperature, is conducted around the third roller 14 and over the reach 48 to the top of the first roller 25 of the sizing unit 10. Cooling of the yarn sheet 1 as it travels in the reach is limited maximally to 5 to 10° C. The limitation of cooling in most cases is assured by the short length of the reach 48. It is possible in addition to maintain the yarn sheet 1 at a temperature close to the wetting agent temperature by means of a thermally insulating cover 51 over the reach 48, which can be provided with a heater 52, if desired.

In the second step the yarn sheet 1 is acted upon by the sizing agent in the size bath in the size box 23 and subsequently squeezed twice. To this end, the yarn sheet 1 is conducted around the top of the first roller 25 into the trough 31, which has been filled with sizing agent through the sizing agent feed device 32, and is acted upon by the sizing agent. The yarn sheet 1 is squeezed for the first time in the squeeze nip 30 underneath the wedge 31. Thereafter, the yarn sheet 1 is conducted around the underside of the second roller 26, and thus through the sizing agent bath in the size box 23, where sizing agent acts on it again. Subsequently the yarn sheet 1 is conducted through the second squeeze nip 35, where it is squeezed to the predetermined residual moisture, to the dryer 4.

The sizing agent acting on the yarn sheet 1 in the second step is heated to a temperature between 100 and 160° C. via the contact surface 41 of the indirect heater in the size box 23. For this purpose, the heating panel 38 is designed as a steam pressure panel supplied with superheated steam, i.e. saturated steam under increased pressure.

The yarn sheet 1 is conducted through the sizing device 3 at a feed speed of 60 to 200 m/min and more.

EXAMPLE

Modified starch is added as the sizing agent and water as the wetting agent, if needed with other additives, to a yarn sheet 1 of cotton with a mass of 100 g/m$^2$ per unit area. The wetting agent temperature is set at 85° C., the residual moisture after wetting (first step) at 40%, the sizing agent temperature at 80° C. and the residual moisture after sizing (second step) at 140%. The heating panel 38, designed as a steam pressure panel, is heated with superheated steam at a temperature of 142° C. and at a pressure of 3 bar. In this case the temperature of the contact surface is approximately 140° C. The feed speed is 120 m/min. During start- up, a dilution of the sizing agent concentration occurs in the first 200 to 600 m, in this case the first 400 m, of the yarn sheet 1. In this case the initial amount of the sizing agent applied to the yarn sheet 1 is higher by 6 to 10%, in this case 8%, than the desired amount. A control or regulation of the applied amount of sizing by elaborate measuring and regulating techniques is not required.

Because of the two-stage method it is possible to save 50% of sizing agent with the same weaving efficiency or, with an improvement of the weaving efficiency by 3%, approximately 20% of the sizing agent can be saved.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for sizing a yarn sheet, comprising: applying a wetting agent at a temperature of 65°–95° C. to the yarn sheet, squeezing the wetted yarn sheet to a selected residual moisture content, applying to the wetted and squeezed yarn sheet a sizing agent that has been indirectly heated to a temperature of 65°–95° C. by contact with a surface at a temperature of 100 °–160° C., squeezing the sized yarn sheet to a selected residual moisture content.

2. The method of sizing a yarn sheet according to claim 1 and characterized further in that the temperature of the wetting agent being applied is approximately 5°–10° C. higher than the temperature of the sizing agent being applied.

3. The method of sizing a yarn sheet according to claim 2 and characterized further in that the yarn sheet between the wetting agent applying and sizing agent applying steps is maintained at a temperature no less than 10° of the sizing agent temperature.

4. The method of sizing a yarn sheet according to claim 1 and characterized further in that the residual moisture in the wetted yarn sheet after squeezing and before sizing is applied is 25% to 60%.

* * * * *